US009221145B2

(12) United States Patent
Brechemier

(10) Patent No.: US 9,221,145 B2
(45) Date of Patent: Dec. 29, 2015

(54) DEVICE FOR BLOCKING AN OPHTHALMIC LENS

(75) Inventor: Bernard Brechemier, Charenton le Pont (FR)

(73) Assignee: ESSILOR INTERNATIONAL (COMPAGNIE GENERALE D'OPTIQUE), Charenton le Pont (FR)

( * ) Notice: Subject to any disclaimer, the term of this patent is extended or adjusted under 35 U.S.C. 154(b) by 925 days.

(21) Appl. No.: 13/449,538

(22) Filed: Apr. 18, 2012

(65) Prior Publication Data

US 2012/0272515 A1 Nov. 1, 2012

(30) Foreign Application Priority Data

Apr. 26, 2011 (FR) ..... 11 01300

(51) Int. Cl.
*B25B 27/14* (2006.01)
*B24B 9/14* (2006.01)
*B24B 13/005* (2006.01)

(52) U.S. Cl.
CPC ..... *B24B 9/146* (2013.01); *B24B 13/005* (2013.01); *Y10T 29/53* (2015.01)

(58) Field of Classification Search
USPC ..... 29/281.4
See application file for complete search history.

(56) References Cited

U.S. PATENT DOCUMENTS 2,765,523 A * 10/1956 Vaughan ..... 29/406
3,121,979 A * 2/1964 Gray et al. ..... 451/240
4,656,590 A * 4/1987 Ace ..... 700/164
4,693,034 A * 9/1987 Vance et al. ..... 451/240
5,454,748 A * 10/1995 Gottschald ..... 451/41
6,290,354 B1 * 9/2001 Safran ..... 351/57
6,464,363 B1 * 10/2002 Nishioka et al. ..... 359/846
7,661,819 B2 * 2/2010 Mazoyer ..... 351/178
7,876,428 B2 * 1/2011 Divo ..... 356/124
2001/0051490 A1 * 12/2001 Siders et al. ..... 451/5
2002/0052167 A1 * 5/2002 Akiyama et al. ..... 451/5
2004/0029496 A1 * 2/2004 Mizuno et al. ..... 451/43

(Continued)

FOREIGN PATENT DOCUMENTS

EP 1243381 A2 * 9/2002 ..... B24B 9/14
EP 2138271 A1 * 12/2009 ..... B24B 13/005

(Continued)

OTHER PUBLICATIONS

French Search Report, dated Nov. 25, 2011, from corresponding French application.

*Primary Examiner* — Lee D Wilson
*Assistant Examiner* — Alvin Grant
(74) *Attorney, Agent, or Firm* — Young & Thompson

(57) ABSTRACT

A blocking device (1) includes: a structure (10); a manipulation arm (30) mounted on the structure to be movable between two extreme positions and including gripper element (33) for gripping a blocking accessory for placing on an ophthalmic lens; guide element (50) for guiding the manipulation arm between its two extreme positions along a path that presents a curved portion and an adjacent rectilinear portion; and drive element (70) for changing the position of the manipulation arm and including a gearwheel that meshes with a rack (40). The rack forms part of the manipulation arm and presents a circularly arcuate portion (41) enabling the manipulation arm to be driven along the curved portion of its path, and a rectilinear portion (42) enabling the manipulation arm to be driven along the rectilinear portion of its path.

11 Claims, 3 Drawing Sheets

(56) References Cited

U.S. PATENT DOCUMENTS

| | | | | |
|---|---|---|---|---|
| 2006/0101629 | A1* | 5/2006 | Kvartler et al. | 29/26 A |
| 2006/0140731 | A1* | 6/2006 | Yamamoto et al. | 408/8 |
| 2007/0015440 | A1* | 1/2007 | Natsume | 451/5 |
| 2007/0291258 | A1* | 12/2007 | Divo | 356/124 |
| 2008/0007690 | A1* | 1/2008 | Mazoyer | 351/177 |
| 2009/0305614 | A1* | 12/2009 | Nauche et al. | 451/43 |
| 2010/0080663 | A1* | 4/2010 | Kim | 408/13 |
| 2010/0184356 | A1* | 7/2010 | Haddadi et al. | 451/5 |
| 2010/0328603 | A1* | 12/2010 | Liguori et al. | 351/159 |
| 2011/0070382 | A1* | 3/2011 | de Rojas et al. | 427/600 |
| 2011/0074439 | A1* | 3/2011 | Nakako | 324/600 |
| 2011/0076923 | A1* | 3/2011 | Takeichi et al. | 451/5 |

FOREIGN PATENT DOCUMENTS

| | | | | |
|---|---|---|---|---|
| FR | 2 608 492 | A1 | 6/1988 | |
| FR | 2866718 | A1 * | 8/2005 | G02C 7/02 |
| WO | WO 0162438 | A1 * | 8/2001 | |
| WO | WO 2005080047 | A1 * | 9/2005 | B24B 13/005 |
| WO | WO 2008142227 | A2 * | 11/2008 | |
| WO | WO 2009135920 | A1 * | 11/2009 | |
| WO | WO 2011076904 | A1 * | 6/2011 | |
| WO | WO 2012049377 | A1 * | 4/2012 | |

* cited by examiner

Fig.1
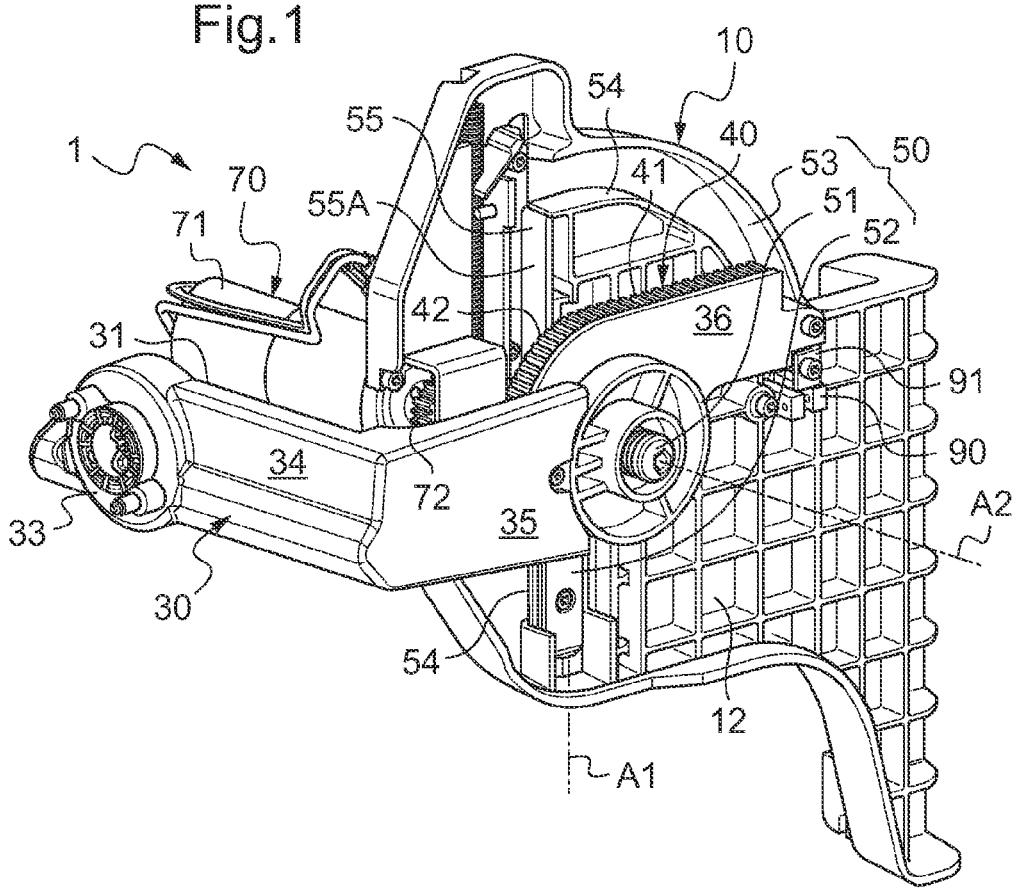
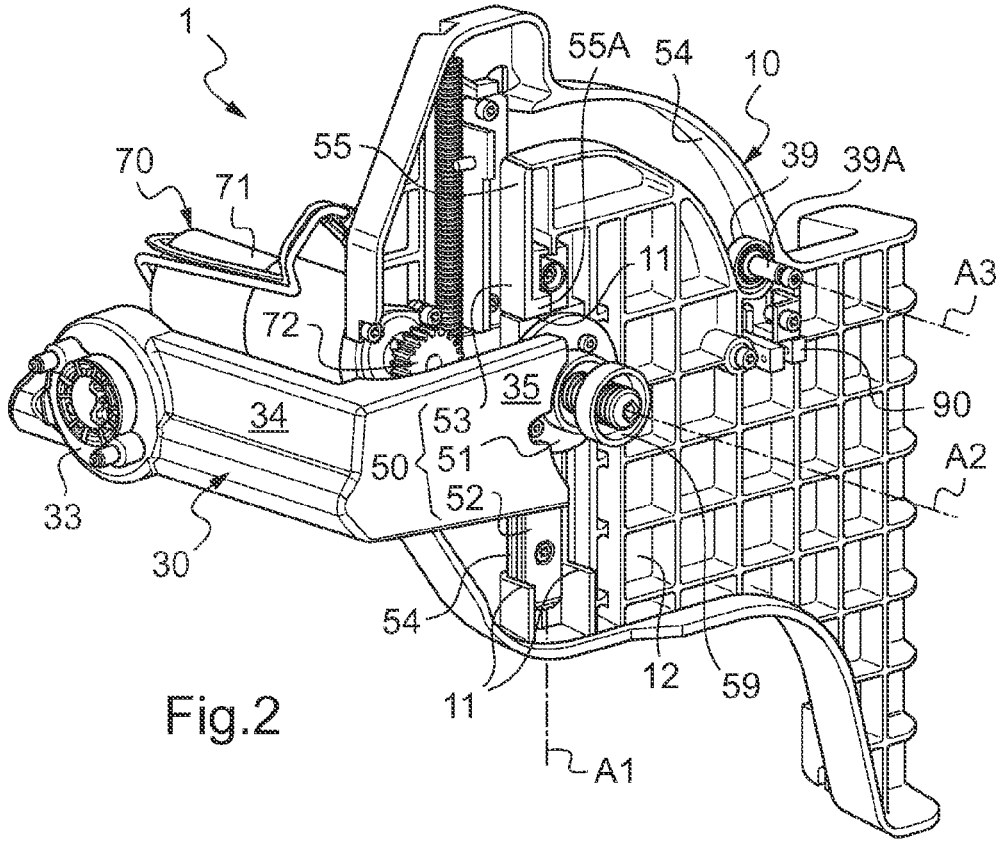
Fig.2

DEVICE FOR BLOCKING AN OPHTHALMIC LENS

TECHNICAL FIELD TO WHICH THE INVENTION RELATES

The present invention relates generally to the equipment needed for preparing an ophthalmic lens so that it can be shaped.

More particularly, the invention relates to a blocking device comprising:

- a structure;
- a manipulation arm mounted on the structure to be movable between two extreme positions and including gripper means for gripping a blocking accessory for placing on an ophthalmic lens;
- guide means for guiding the manipulation arm between its two extreme positions along a path that presents a curved portion and an adjacent rectilinear portion; and
- drive means for changing the position of the manipulation arm and comprising a wheel cooperating with a drive surface.

The invention also provides a centering and blocking appliance having a support for supporting an ophthalmic lens, centering means for centering said ophthalmic lens, and a blocking device as specified above.

TECHNOLOGICAL BACKGROUND

The technical part of the profession of an optician consists in mounting a pair of ophthalmic lenses in an eyeglass frame that has been selected by a client, and it comprises four main operations:

- acquiring the shapes of the outlines of the surrounds of the eyeglass frame selected by the client;
- centering each ophthalmic lens in a centering and blocking appliance, which consists in identifying the frame of reference of the lens with the help of centering marks provided thereon, and then appropriately positioning the ophthalmic lens in the appliance;
- blocking each lens, which consists in fastening a blocking accessory on the lens in such a manner as to enable the lens subsequently to be gripped and moved without losing its frame of reference; and then
- shaping each lens, which consists in machining the lens to have the outline as acquired in a frame of reference that is identified relative to the blocking accessory, and in such a manner that once the lens has been mounted in the eyeglass frame, it is correctly positioned relative to the corresponding eye of the client so as to perform, as well as possible, the optical function for which it has been designed.

More precisely, the present invention relates to the blocking operation which, in practice, consists in placing the blocking accessory on the ophthalmic lens in such a manner as to enable it to adhere to the front face of the lens in releasable manner.

It is possible for the blocking accessory to be put into place manually. However that is found to be relatively inaccurate, such that in practice this is usually done with the help of a blocking device.

A blocking device of the kind defined in the introduction is well known from document FR 2 608 492.

In that document, the manipulation arm is of elongate shape, having a first end that carries the gripper means for gripping the blocking accessory, and a second end that carries a cam with a portion that is rectilinear and another portion that is rounded.

The manipulation arm is then mounted to move between two extreme positions referred to as a rest position and as an activation position.

In the rest position, the manipulation arm extends horizontally at a distance from the lens support, so that the optician can easily access the gripper means in order to install a blocking accessory thereon.

In the activation position, which marks the end of a rectilinear portion of the path of the manipulation arm, the blocking accessory comes into contact with the ophthalmic lens that is to be fitted therewith.

The path of the manipulation arm between these two extreme positions is guided by the cam in that example.

Movement is imparted to the arm by two units fitted with two respective facing rectilinear racks that are driven by a common gearwheel so that both of them move in translation parallel to each other but in mutually opposite directions.

The drawback of that device is that it is bulky, that it presents architecture that is complex, and that it is therefore expensive to fabricate.

OBJECT OF THE INVENTION

In order to remedy the above-mentioned drawbacks of the state of the art, the present invention provides a blocking device that presents architecture that is simplified.

More particularly, the invention provides a blocking device as defined in the introduction, wherein the drive surface forms part of the manipulation arm and presents a circularly arcuate portion enabling the wheel to drive the manipulation arm along the curved portion of its path and a rectilinear portion enabling the wheel to drive the manipulation arm along the rectilinear portion of its path.

Thus, by means of the invention, the wheel and the drive surface suffice to impart curved movement followed by rectilinear movement to the manipulation arm.

A smaller number of parts are therefore needed for assembling the blocking device, with that being beneficial to its size and to its cost.

Other characteristics of the blocking device in accordance with the invention that are advantageous and non-limiting are as follows:

- the wheel is constituted by a gearwheel and said drive surface is constituted by a rack;
- the circularly arcuate portion extends over at least one-fourth of a circle;
- said guide means comprise a ring that is mounted to move in translation on the structure and on which the manipulation arm is mounted to move in rotation;
- said guide means comprise a rail fastened to the structure, with said ring being mounted to move in translation on the rail;
- said guide means include a cam;
- said cam is formed by a groove formed in the structure, the groove having a circularly arcuate portion and a rectilinear portion, and a wheel of the manipulation arm being engaged in the groove;
- said drive means comprise a motor for driving said wheel in rotation;
- electronic and/or computer control means are provided for said motor, which control means are connected to at least one position sensor adapted to detect the manipulation arm; and said drive means comprise an operating handle for driving said gearwheel in rotation manually.

DETAILED DESCRIPTION OF AN EMBODIMENT

The following description with reference to the accompanying drawings, given as non-limiting examples, shows what the invention consists in and how it can be reduced to practice.

In the accompanying drawings:

FIG. 1 is a diagrammatic perspective view of the blocking device of the invention, in which the manipulation arm of the blocking device is in a loading position;

FIG. 2 is a view analogous to FIG. 1, in which the base of the manipulation arm is hidden;

Figure 3:
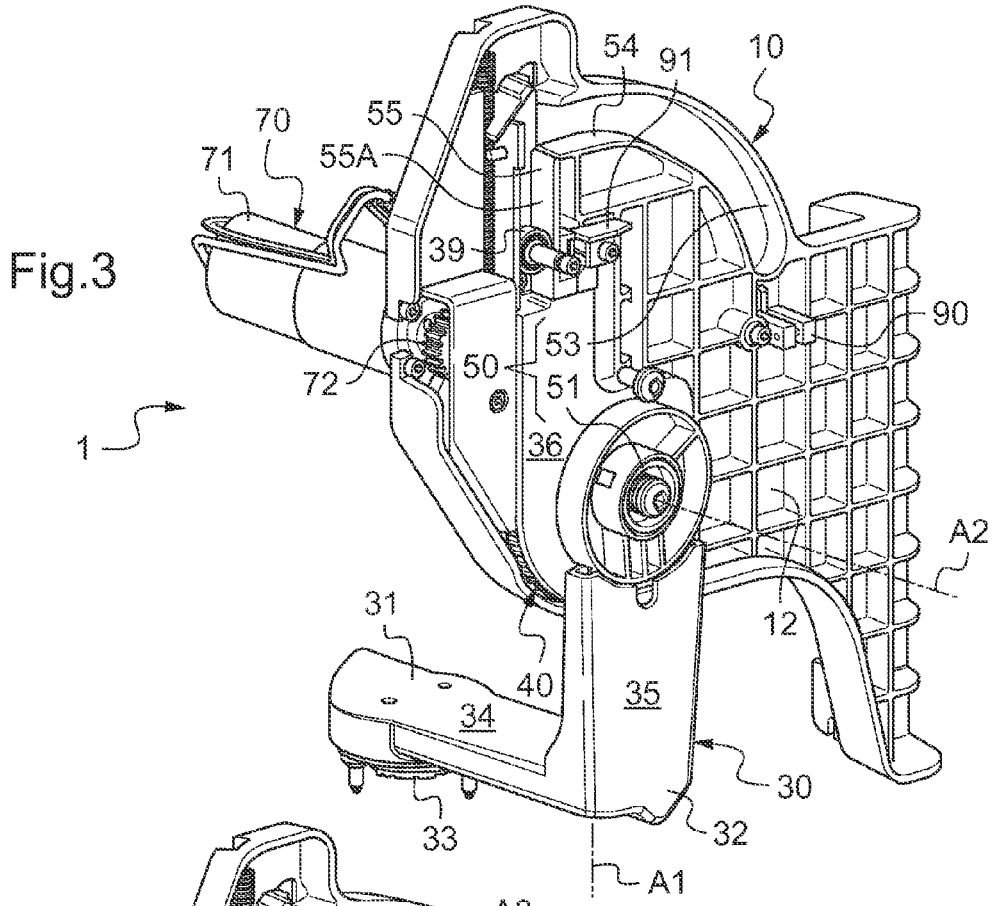
FIG. 3 is a diagrammatic perspective view of the FIG. 1 blocking device in which the manipulation arm of the blocking device is in a deposition position.

A centering and blocking appliance is generally used by an optician after acquiring the outline shapes of the surrounds of an eyeglass frame selected by a client, in order to perform the operations of centering and blocking the ophthalmic lenses that are to be mounted on the eyeglass frame.

The purpose of the centering operation is to identify the frame of reference of the ophthalmic lens and then to determine the position that is to be occupied by the outline of the surround in this frame of reference so that once the lens has been shaped to have the outline and then mounted on the eyeglass frame, it is appropriately centered in front of the corresponding eye of the individual.

The purpose of the blocking operation is to deposit a blocking accessory on the ophthalmic lens, at a given centering point and with a determined orientation, firstly to facilitate taking hold of the lens in order to transport it from the centering and blocking appliance to a shaper appliance, and secondly to provide a stable reference point enabling the position of the frame of reference of the lens to be retained while the lens is being transported.

For this purpose, such a centering and blocking appliance comprises:

- a support for supporting the ophthalmic lens;
- a blocking device for performing the operation of applying the block to the ophthalmic lens; and
- centering means for implementing the operation of centering the ophthalmic lens, serving in particular to place the lens in a given position under the blocking device, and to do so with a given orientation.

The support and the centering means are well known to the person skilled in the art and do not themselves form part of the subject matter of the present invention, so they are not described in greater detail herein.

The invention relates more particularly to the blocking device.

As shown in FIG. 1, the blocking device 1 comprises a structure 10 arranged to be fastened on the structure of the centering and blocking appliance, and a manipulation arm 30 that includes gripper means 33 for gripping a blocking accessory and that is movably mounted on the structure 10.

The blocking accessory (not shown in the figures) is of conventional type and does not in itself form part of the present invention.

In outline, it comprises a block having a support that is adapted to co-operate releasably with the gripper means 33 of the manipulation arm 30, and an attachment face suitable for adhering to the ophthalmic lens, e.g. by adhesive or by suction.

In order to deposit the blocking accessory on the ophthalmic lens, the manipulation arm 30 is mounted to move on the structure 10 along a predetermined path between two extreme positions. These two extreme positions are referred to respectively as the loading position and the deposition position.

In the loading position, the manipulation arm 30 is oriented in such a manner that its gripper means 33 are accessible in front so that the optician can fit a blocking accessory thereto. In the deposition position, the manipulation arm 30 is situated in such a manner that the attachment face of the blocking accessory that it is carrying rests on the front face of the ophthalmic lens onto which it is to be fitted.

Figure 4:
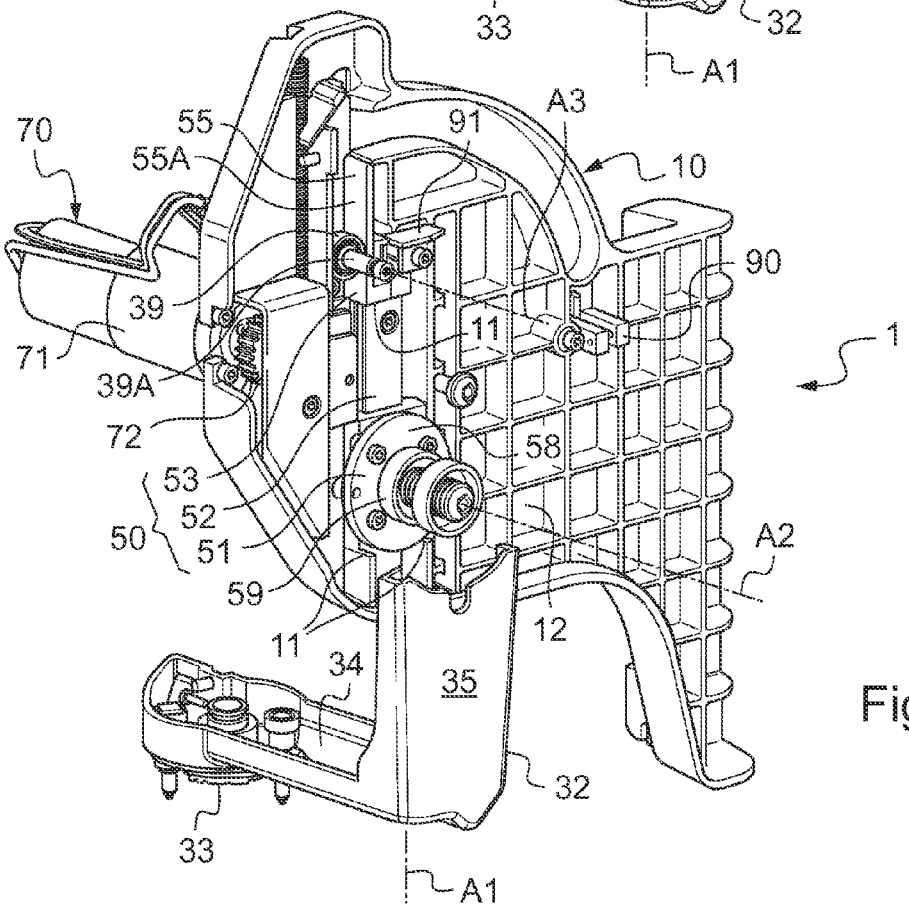
FIG. 4 is a view analogous to FIG. 3, in which the base of the manipulation arm is hidden.

In practice, in the loading position (FIGS. 1 and 2), the gripper means 33 should be horizontally oriented in order to make it easier to mount the blocking accessory. In contrast, while the blocking accessory is being deposited on the ophthalmic lens (FIGS. 3 and 4), the gripper means 33 need to be vertically oriented so that the blocking accessory is placed on the front face of the lens along a vertical centering axis that passes through the centering point of the lens.

In order to move from the loading position to the deposition position, the manipulation arm 30 thus needs to perform two distinct movements, a movement in rotation and then a movement in translation.

The blocking device 1 thus has guide means 50 for guiding the manipulation arm 30 between its two extreme positions along a path that presents a curved portion and a rectilinear portion adjacent thereto.

It also has drive means 70 for moving the manipulation arm 30 towards one or the other of these two extreme positions, and control means for controlling the drive means.

According to a particularly advantageous characteristic of the invention, the drive means 70 comprise a gearwheel 73 meshing with a rack 40 that is provided on the manipulation arm 30 and that presents a circularly arcuate portion 41, thereby enabling the manipulation arm 30 to be driven along the curved portion of its path, and a rectilinear portion 42, thereby enabling the manipulation arm 30 to be driven along a rectilinear portion of its path.

In order to enable the manipulation arm 30 to pivot from a position in which its gripper means 33 are horizontally oriented to a position in which its gripper means 33 are vertically oriented, the circularly arcuate portion 41 of the rack 40 extends over at least one-fourth of a circle.

In order to enable the manipulation arm 30 to move along the centering axis through a distance that is sufficient to be able to deposit the blocking accessory on the front face of the ophthalmic lens regardless of the height of the centering point along said axis (which height varies as a function of the thickness and the curvature of the lens), the rectilinear portion 42 of the rack 40 extends over at least 20 millimeters (mm).

In the embodiment of the invention shown in the various figures, the structure 10 includes a plate 12 with a rear face (the face that is not visible in the figures) that is plane, and a front face (the face that is visible in the figures) that carries stiffening ribs.

In this example, the manipulation arm 30 is made of two L-shaped portions that are fastened together, the portions comprising a base 31 (FIG. 5) and a cover 32 (FIG. 2) that covers the base 31 to improve its appearance.

The manipulation arm 30 is thus generally L-shaped, having a first branch 34 with the gripper means 33 situated at the end thereof, and a second branch 35 that carries the rack 40.

Figure 5:
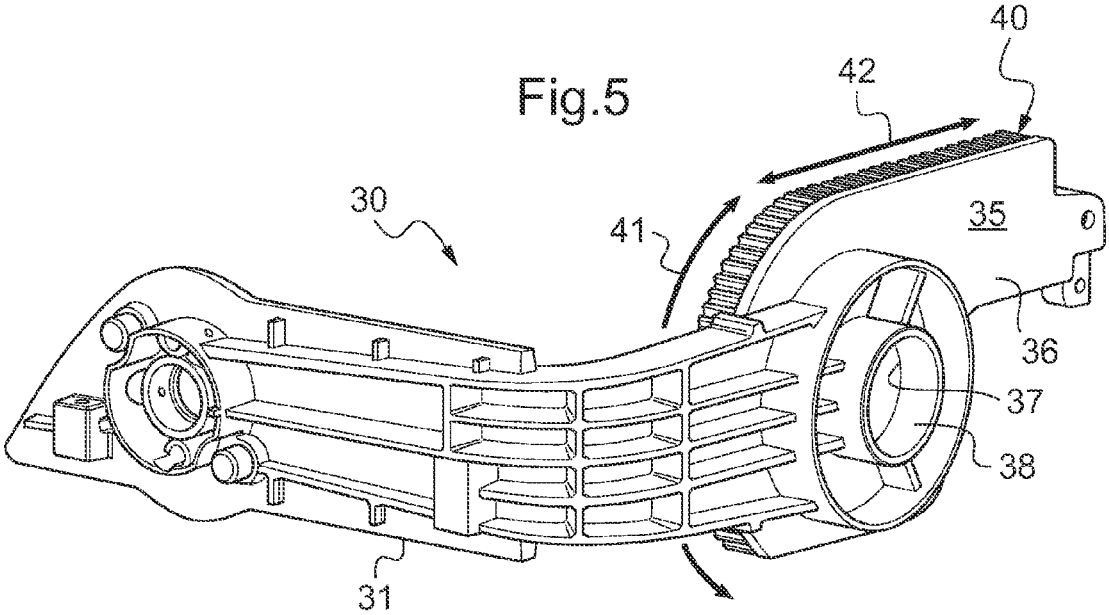
FIG. 5 is a diagrammatic perspective view of the base of the manipulation arm of the FIG. 1 blocking device.

As can be seen in FIG. 5, the second branch 35 of the base 31 has a plane wall 36 that carries the rack 40 on its rear face, and that has stiffening ribs on its front face.

In this example, the plane wall 36 presents an outline having a portion that is rectilinear and a portion that is arcuate, such that it is bordered over a portion of its outline by the rack 40.

Figure 6:
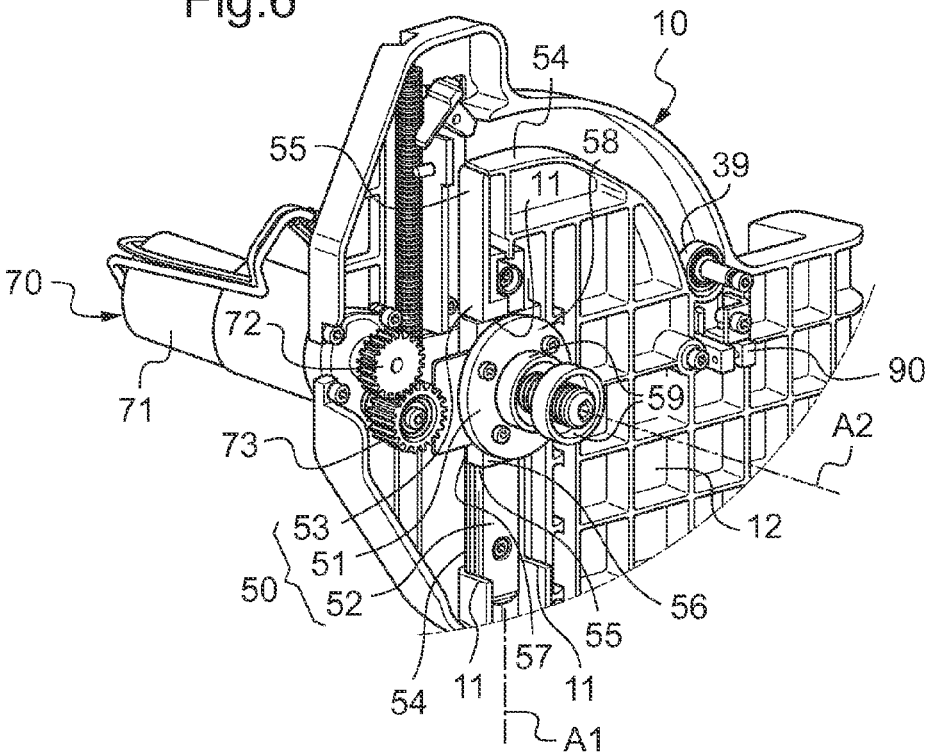
FIG. 6 is a diagrammatic perspective view of control means for controlling the manipulation arm of the FIG. 1 blocking device.

As shown in FIG. 6, the guide means 50 for guiding the manipulation arm 30 comprise a rail 52 that is screwed onto the front face of the plate 12 of the structure 10 to extend along a vertical axis referred to as the translation axis A1. It also has a ring 51 that is mounted to move in translation along the rail 52 and onto which the manipulation arm 30 is mounted so as to be movable in rotation about a horizontal axis referred to as the rotation axis A2 (see FIGS. 1 and 3).

For this purpose, the rail 52 presents an H-shaped cross-section so as to define two longitudinal grooves 54 recessed in each of its edge faces, the grooves extending along axes parallel to the translation axis A1.

The ring 51 comprises two portions, including a slider 55 mounted to move freely in translation on the rail 52 along the translation axis A1, and a disk 58 on which the manipulation arm 30 is mounted to move in rotation about the rotation axis A2.

The slider 55 is of channel-section, having a plane web 56 between two plane flanges 57.

It is mounted on the rail 52 in such a manner that the two plane flanges 57 press against the two edge faces of the rail 52.

In order to hold the slider 55 on the rail 52, the inside faces of the two plane flanges 57 present longitudinally-extending splines (not visible in the figures) that are engaged in the two longitudinal grooves 54 of the rail 52.

In order to limit the amplitude of the movement of the slider 55 on the rail 52, abutments 11 carried by the structure 10 are provided at each end of the rail 52.

The disk 58 is screwed onto the slider. For this purpose, it comprises a disk proper centered on the axis of rotation A2, and pierced by openings for fastening fastener screws, together with a rod that projects from the center of the disk away from the slider and that carries two ball bearings 59.

Correspondingly, the plane wall 36 of the manipulation arm 30 presents a circular opening 37 that is bordered on its front face by a ring 38. The ring 38 constitutes a cylinder of revolution about the axis of the circularly arcuate portion 41 of the rack 40 and it is mounted as a force-fit on the two ball bearings of the ring 51 so as to enable the manipulation arm 30 to pivot freely on the rod of the disk 58 about the rotation axis A2.

Although the above-mentioned ring 51 serves to guide the manipulation arm 30 in translation along the translation axis A1 and in rotation about the rotation axis A2, it does not on its own suffice to constrain the manipulation arm 30 to follow a path that comprises both a curved portion and an adjacent rectilinear portion.

As shown in FIGS. 1 to 4, the guide means 50 of the manipulation arm 30 include a cam 53 having a wheel 39 engaged therein, which wheel is provided on the second branch 35 of the manipulation arm 30.

The cam 53 is then in the form of a groove presenting two distinct portions.

Firstly it presents a circularly arcuate portion 54 that is defined between two stiffening ribs of the structure 10 and that is centered about the rotation axis A2 of the ring 51 when the ring is in its high position on the rail 52.

The cam also presents a rectilinear portion 55 that is defined between the two flanges of a channel-section girder 55A. For this purpose, the girder 55A is screwed onto the structure 10 so as to extend along an axis parallel to the translation axis A1, and in such a manner that its top end is in communication with the circularly arcuate portion 54 of the cam 53.

The wheel 39 is of cylindrical shape about an axis A3 parallel to the rotation axis A2. It presents a diameter equal to the width of the cam 53 and it is mounted to rotate on a shaft 39A provided at the end of the second branch 35 of the manipulation arm 30, so as to be capable of rotating freely about the axis A3.

The manipulation arm 30 may thus pivot about the rotation axis A2 only while the wheel 39 is engaged in the circularly arcuate portion 54 of the cam 53. It may move in translation along the translation axis A1 only while the wheel 39 is engaged in the rectilinear portion 55 of the cam 53.

As explained above, the position of the manipulation arm 30 along this path is changed under drive from the gearwheel 73 (FIG. 6) that meshes with the rack 40 (FIG. 5).

The gearwheel 73 may itself be driven manually. For this purpose, it suffices to constrain the gearwheel to rotate with an operating handle that is made accessible to the optician.

Nevertheless, in the embodiment shown, the gearwheel is driven automatically. The gearwheel 73 is then mounted to rotate freely about a shaft that is fastened to the plate 12 of the structure 10, thereby rotating about an axis that is parallel to the rotation axis A2. It also meshes with another gearwheel 72 that is itself constrained to rotate with the shaft of a direct current (DC) motor 71 that is fastened to the plate 12 of the structure 10.

In practice, in the embodiment shown, the DC motor 71 is fastened by screws to the rear face of the plate 12 of the structure 10, and its shaft projects from the front face of the plate 12 of the structure 10 by passing through a window placed in register therewith in the plate 12.

Thus, when the shaft of the DC motor 71 turns in one direction, the gearwheel 73 serves initially to cause the manipulation arm 30 to pivot about the rotation axis A2, and then subsequently to cause the manipulation arm 30 to move in translation along the translation axis A1, so as to move it from its loading position to its deposition position.

In contrast, when it rotates in the opposite direction, the gearwheel 73 serves to move the manipulation arm from its deposition position to its loading position.

In this example, the control means of the DC motor comprise an electronic unit (not shown) having two inputs, a first input connected to a monostable switch (not shown in the figures) that is accessible to the optician, and a second input connected to a position sensor 90.

When the monostable switch is pressed, the electronic unit is programmed to cause the shaft of the DC motor 71 to rotate in a first direction so as to move the manipulation arm 30 towards its deposition position.

When the monostable switch is subsequently released, the electronic unit is programmed to cause the shaft of the DC motor 71 to rotate in the opposite direction so as to move the manipulation arm 30 towards its loading position.

The position sensor 90 is then adapted to detect the presence of the manipulation arm 30 when it reaches the loading position, so that the electronic unit can stop the shaft of the DC motor 71.

For this purpose, the position sensor 90 in this example comprises a Hall effect cell that is fastened to the plate 12 of the structure 10 close to the curved end of the cam 53 and that is adapted to detect variation in the electromagnetic field generated by a magnetized plate 91 fastened close to the end of the second branch 35 of the manipulation arm 30.

By means of this electronic unit, the blocking operation is performed as follows.

At rest, the manipulation arm 30 is situated in its loading position, such that the optician can install the blocking accessory on its gripper means 33.

Once the blocking accessory has been installed, the optician presses the monostable switch so that the DC motor 71 is caused to rotate in a first direction, thereby causing the manipulation arm 30 to tilt and then to move down towards its deposition position. In this position, the blocking accessory becomes fastened to the front face of the ophthalmic lens.

When the optician is of the opinion that the blocking accessory is properly attached to the ophthalmic lens, the optician releases the monostable switch so that the DC motor 71 rotates in the opposite direction, thereby causing the manipulation arm 30 to move upwards and then to tilt towards its loading position.

The position sensor 90 then enables the electronic unit to cause the DC motor 71 to stop as soon as the manipulation arm reaches its loading position.

The present invention is not limited in any way to the embodiment that is described and shown, and the person skilled in the art knows how to apply any variation thereto in accordance with its spirit.

In particular, provision may be made to replace the gearwheel 73 by an ordinary wheel having its outside face covered in a material that provides grip (such as rubber), and to replace the rack 40 by a track having a rectilinear portion and a circularly arcuate portion.

In another variant of the invention, provision may be made for the first branch of the manipulation arm itself to act as a control handle, in which case the gearwheel and the rack serve to contribute to guiding the manipulation arm.

The invention claimed is:

1. A blocking device (1) comprising:

a structure (10);

a manipulation arm (30) mounted on the structure (10) to be movable between two extreme positions and including gripper means (33) for gripping a blocking accessory for placing on an ophthalmic lens;

guide means (50) for guiding the manipulation arm (30) between the two extreme positions along a path that presents a curved portion and an adjacent rectilinear portion; and drive means (70) for changing the position of the manipulation arm (30) and comprising a wheel (73) engaging a drive surface (40), wherein the drive surface (40) forms part of the manipulation arm (30) and presents a circularly arcuate portion (41) enabling the wheel (73) to drive the manipulation arm (30) along the curved portion of the path and a rectilinear portion (42) enabling the wheel (73) to drive the manipulation arm (30) along the rectilinear portion of the path.

2. A blocking device according to claim 1, wherein the wheel is constituted by a gearwheel (73) and said drive surface is constituted by a rack (40).

3. A blocking device according to claim 1, wherein the circularly arcuate portion (41) extends over at least one-fourth of a circle.

4. A blocking device according to claim 1, wherein said guide means (50) comprise a ring (51) that is mounted to move in translation on the structure (10) and on which the manipulation arm (30) is mounted to move in rotation.

5. A blocking device according to claim 4, wherein said guide means (50) comprise a rail (52) fastened to the structure (10), with said ring (51) being mounted to move in translation on the rail.

6. A blocking device according to claim 5, wherein said guide means (50) include a cam (53).

7. A blocking device according to claim 6, wherein said cam (53) is formed by a groove formed in the structure (10), the groove having a circularly arcuate portion (54) and a rectilinear portion (55), and a wheel (39) of the manipulation arm (30) being engaged in the groove.

8. A blocking device according to claim 1, wherein said drive means (70) include a motor (71) for driving rotation of said wheel (73) and wherein computer means are provided for controlling said motor (71), which computer means are connected to at least one position sensor (90) adapted to detect the manipulation arm (30).

9. A blocking device according to claim 1, wherein said drive means comprise an operating handle for driving said wheel in rotation manually.

10. A centering and blocking appliance comprising:

a support for supporting an ophthalmic lens;

centering means for centering said ophthalmic lens; and a blocking device (1) adapted to deposit a blocking accessory on said ophthalmic lens;

the appliance being characterized in that the blocking device (1) is a device in accordance with claim 1.

11. A blocking device according to claim 1, wherein said drive means (70) include a motor (71) for driving rotation of said wheel (73) and wherein electronic means are provided for controlling said motor (71), which electronic means are connected to at least one position sensor (90) adapted to detect the manipulation arm (30).

* * * * *